United States Patent [19]

Kolb et al.

[11] 3,968,820

[45] July 13, 1976

[54] MIXING CONTAINER

[75] Inventors: Walter Kolb; Dieter Achenbach, both of Betzdorf, Germany

[73] Assignee: Wolf-Gerate GmbH, Germany

[22] Filed: Apr. 17, 1974

[21] Appl. No.: 461,711

[30] Foreign Application Priority Data

Apr. 17, 1973 Germany ..... 2319453

[52] U.S. Cl. ..... 141/330; 206/222; 215/DIG. 8; 222/88

[51] Int. Cl.[2] ..... B65B 1/04; B65D 25/00

[58] Field of Search ..... 137/614.02; 141/2, 18, 141/19, 95, 98, 193, 329, 330, 351–353, 363, 364, 375; 206/219, 222; 215/DIG. 8, DIG. 6; 222/81, 83, 83.5, 87, 88

[56] References Cited

UNITED STATES PATENTS

| | | | |
|---|---|---|---|
| 732,203 | 6/1903 | Lowry | 141/330 X |
| 1,766,182 | 6/1930 | Markus | 141/330 X |
| 2,139,143 | 12/1938 | Wiswell | 222/87 X |
| 2,536,221 | 1/1951 | Rector et al. | 222/88 |
| 3,742,988 | 7/1973 | Kush | 141/2 |

*Primary Examiner*—Richard E. Aegerter
*Assistant Examiner*—Frederick R. Schmidt
*Attorney, Agent, or Firm*—Ostrolenk, Faber, Gerb & Soffen

[57] ABSTRACT

The specification describes a mixing container for dissolving corrosive or poisonous chemicals, supplied in a sealed package, in a solvent. The container comprises a filling neck, which can be closed by a lid, for the chemicals, more particularly for the production of a plant protective spraying liquid, characterized by the following features. The filling neck is provided with a sleeve extension, directed towards the interior of the container, for receiving an as yet unopened chemical package. The sleeve extension in the interior part has an opener for the package and this opener becomes effective on pressing the package into the sleeve extension and the opener causes the content of the package to move past it into the container.

9 Claims, 8 Drawing Figures

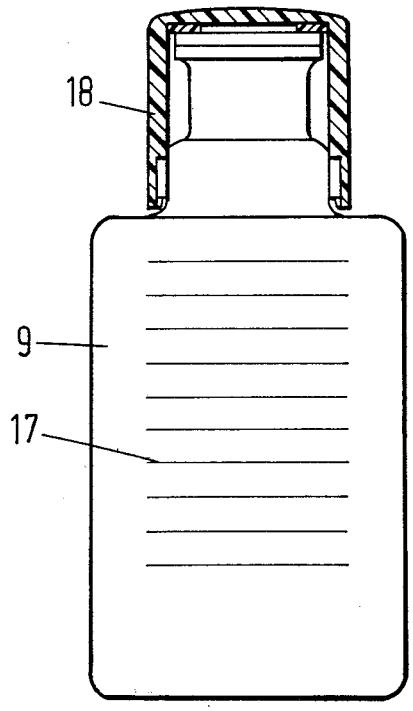
Fig. 5
Fig. 6
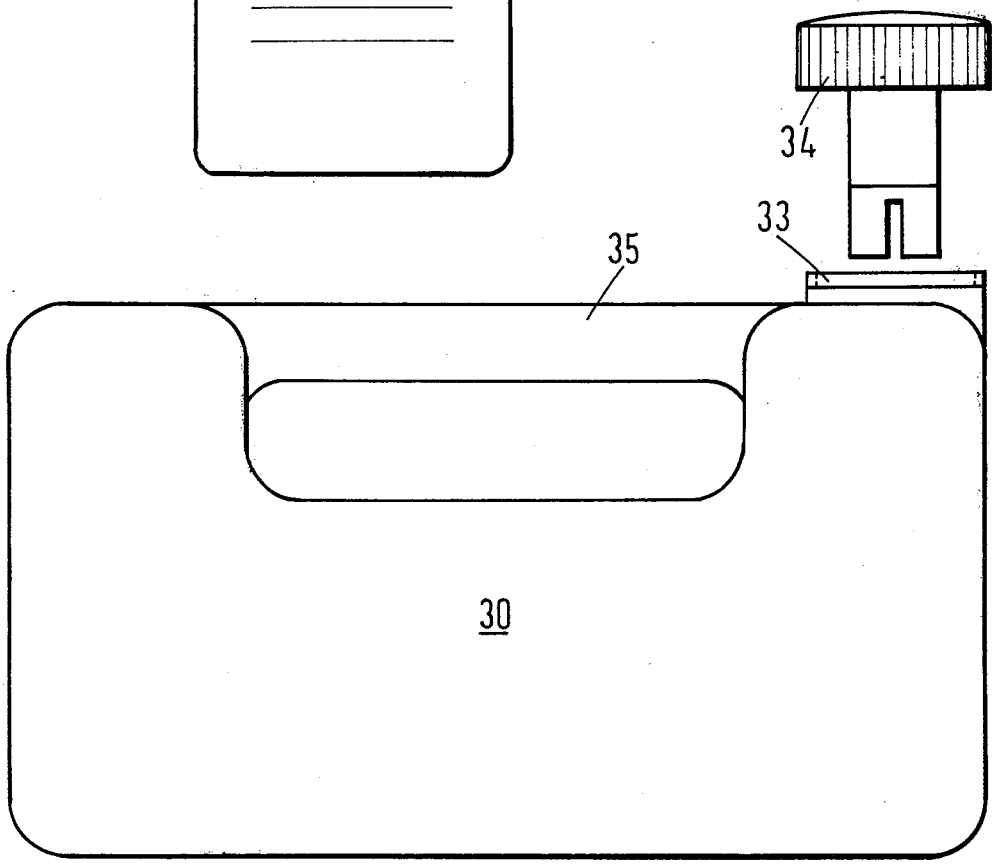

MIXING CONTAINER

BACKGROUND OF INVENTION

1. Field to which invention relates

The invention relates to a mixing container for dissolving corrosive or poisonous chemicals, supplied in a sealed package, in a solvent and comprising a filling neck, which can be closed by a lid, for the chemicals, more particularly for the production of a plant protective spraying liquid.

2. The prior art

In the field of combatting pests, and also however in many other fields of application, it is frequently found to be necessary to supply the chemicals to be used in a concentrated form to the user. Supply in a concentrated form is desired on the one hand for reasons of reducing the transport volume and the transport weight, more particularly when water is used as a solvent. An absolute necessity arises for the supply in a concentrated form in many cases due to the fact that these agents can only be stored for long periods of time in a concentrated form and in the dissolved or diluted condition decompose relatively rapidly and thus become unusable.

In many cases the chemicals supplied as a liquid or solid concentrate constitute a danger for the user, if he or she should by mistake come into contact with the concentrated chemicals or become exposed to their vapours. This danger especially arises in the case of the production of plant protective spraying liquids, which are used by gardeners who often have no experience as regards application or dissolving. These possible dangers in the case of the use of poisonous or corrosive chemicals have in the past discouraged many gardeners from using such chemicals (which as such are desirable for the care of plants or the combatting of pests) more particularly when the household includes children.

SUMMARY OF INVENTION

One aim of the invention is therefore that of facilitating the preparation or mixing of solutions from a dangerous concentrate and a solvent, more particularly the mixing of plant protective spraying liquids, and ensuring that direct contact with the concentrate or residues is reliably avoided on mixing or dissolving as the case may be.

The present invention consists in a mixing container for dissolving corrosive or poisonous chemicals, supplied in a sealed package, in a solvent and comprising a filling neck, which can be closed by a lid, for the chemicals, more particularly for the production of a plant protective spraying liquid, characterised in that the filling neck is provided with a sleeve extension, directed towards the interior of the container, for receiving an as yet unopened chemical package and in that the sleeve extension in the interior part has an opener for the package and this opener becomes effective on pressing the package into the sleeve extension and the opener causes the content of the package to move past it into the container.

In this manner it is possible to ensure that the chemicals emerge at a position, that is to say at the bottom of the sleeve projection or extension from the package, which in the case of proper usage is inaccessible so that the making of contact is impossible.

The pressing of the package into position can be carried out manually if the package is suitably designed. In accordance with a preferred form of the invention this pressing into position is however carried out indirectly, that is to say more particularly on placing in position or screwing on the lid adapted to close the neck owing to the fact that the lid either directly acts on the container (for example on the lower end of a bottle fitted round) or owing to the fact that a pressing punch, fixed on the lid, acts on the package to press it downwards.

In particular there is the feature in accordance with the invention that the package can be so constructed that it can only be opened by means of the specially constructed opener within the sleeve extension. In the case of the use of a bottle as a concentrate package the valve cooperating with the opener, for example a ball valve, can be set deep in the bottle neck so that also after removal of the bottle out of the sleeve extension no traces of the concentrate are to be found on the opening of the bottle neck.

In the case of the use of the bottle as a package the latter is preferably provided with a measuring scale, which can be seen through the surrounding sleeve extension or a slit in the latter respectively so that the quantity for a certain portion of solvent can be precisely metered out since after screwing back the lid the valve, which is acted upon by a spring, automatically closes. In the case of the use of capsules a number of them, corresponding to the quantity of solvent, can be introduced into the sleeve extension and then be broken open one after the other or simultaneously.

LIST OF SEVERAL VIEWS OF DRAWINGS

In what follows embodiments of the invention will be described with reference to the accompanying drawings.

FIG. 5 shows a partially sectioned view of a bottle-like concentrate package for liquid concentrate.

FIG. 6 shows a side view of a modified embodiment of a mixing container.

DESCRIPTION OF PREFERRED EMBODIMENTS

Figure 1:
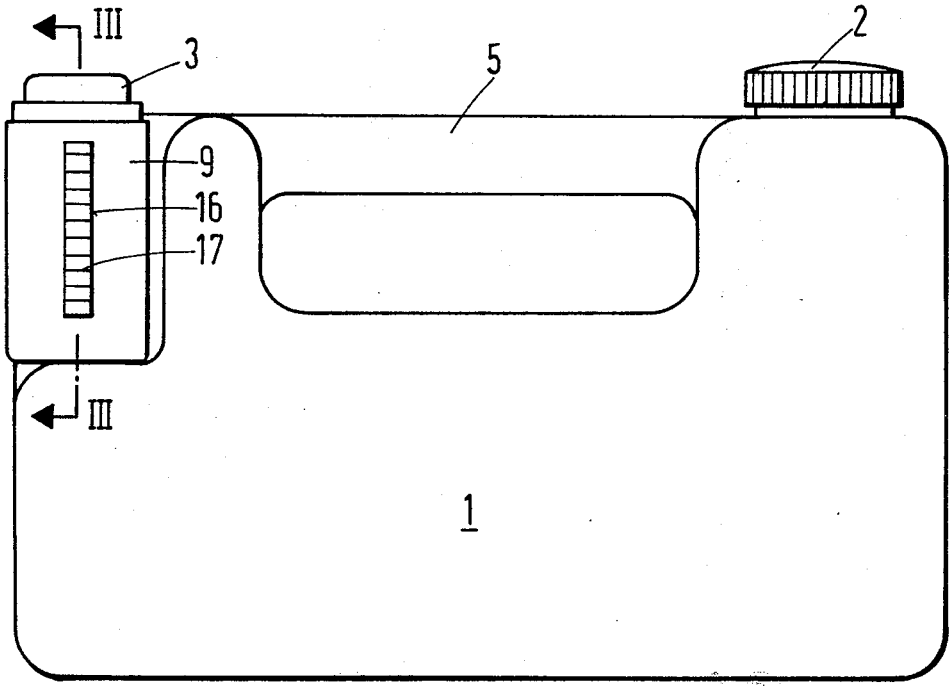
FIG. 1 shows a side view of a mixing container constructed in accordance with the invention.
Figure 2:
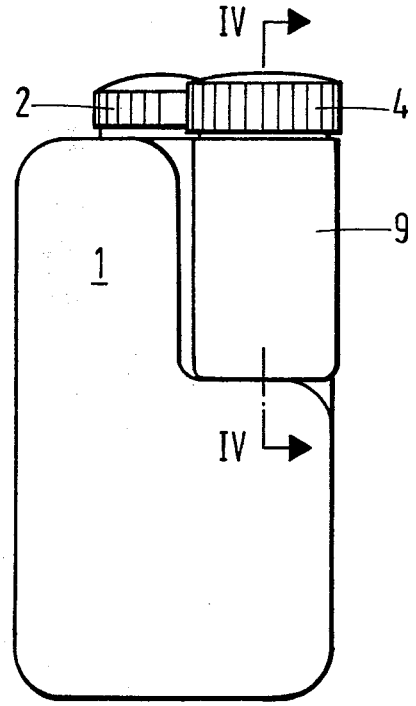
FIG. 2 is an end view of the container shown in FIG. 1.
Figure 3:
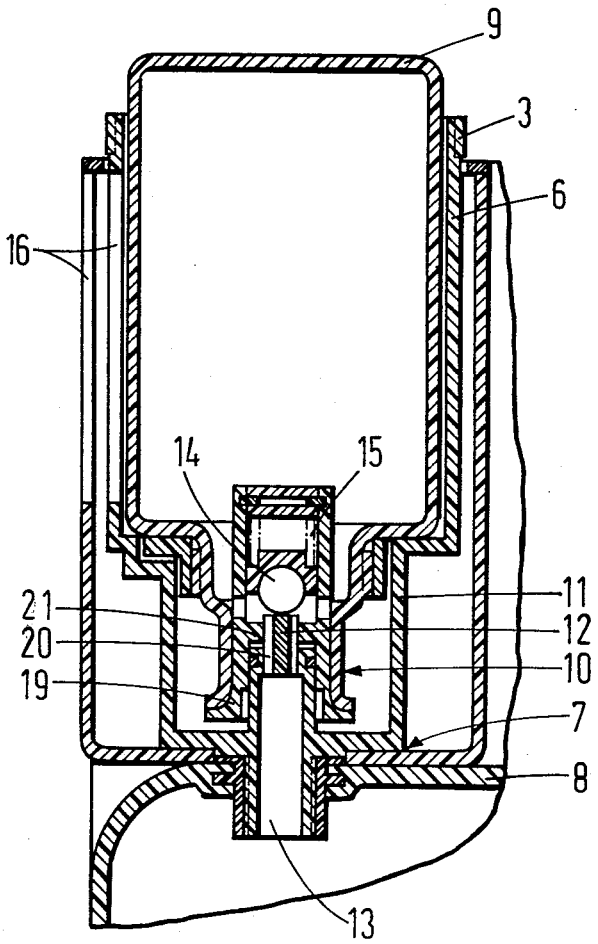
FIG. 3 shows on a larger scale a sectional view on the line III—III in accordance with FIG. 1.
Figure 4:
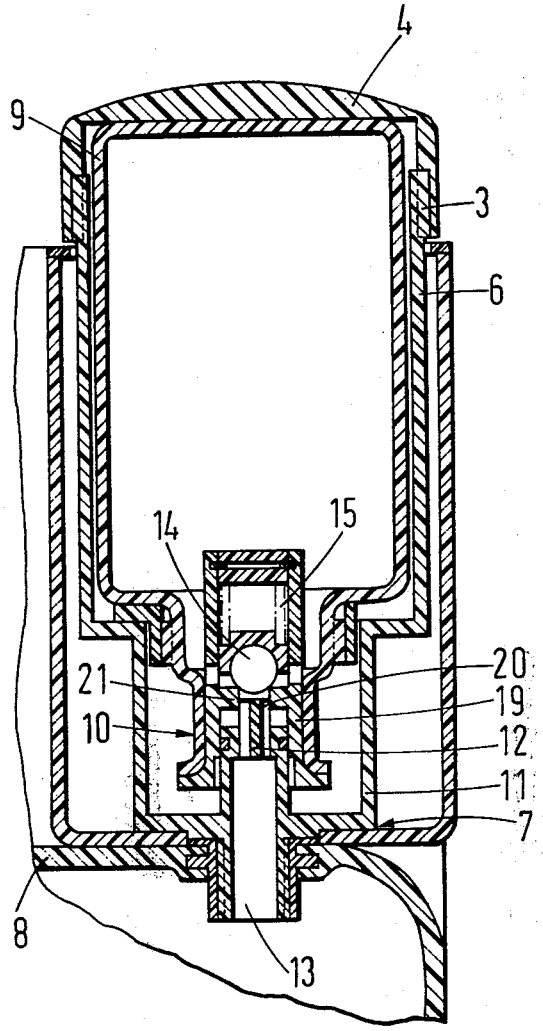
FIG. 4 shows on a larger scale a section on the line IV—IV in accordance with FIG. 2.

In accordance with the embodiment of the invention of FIGS. 1 to 5 the mixing container 1 has a water supply neck with a screw on lid 2, a separate chemical inlet neck 3 with a screw on lid 4 and a carrying handle 5. The neck 3 is provided internally with a sleeve extension 6, which is fixed in a suitable manner inside the container 1 and whose inner opening 7 lies on a horizontally extending container wall 8. The diameter of the sleeve extension 6 is adapted to suit the diameter of a bottle 9, which contains the concentrate and can be inserted so as to fit round. The sleeve section 10 of the bottle is surrounded by a section 11, which is of reduced diameter, of the sleeve extension. Within the lower section of the sleeve extension there is a pin 12 with an adjoining liquid passage duct 13, which in the position in accordance with FIGS. 3 and 4 extends into the bottle neck 10 and moves into the open position the ball 14 of a ball valve placed in a withdrawn position in the bottle neck, the movement of the ball being opposed by the force of the spring 15, when the bottle 9 is pressed down by hand or, in accordance with FIG. 4, by means of the screw on lid 4. In this case the liquid of the bottle container 9 can flow out without obstruction into the mixing container. The sleeve extension 6 and, respectively, the container wall have inspection slots 16, through which the quantity of liquid within the transparent container 9 can be inspected. This container 9 is conveniently provided with a measuring scale 17. For liquid-tight closure of the bottle 9 a screw on cap 18 is provided. The housing 19 of the ball valve 14, 15 is mounted in a sealing manner in the bottle neck 10 and the outlet opening 20, into which the pin, which is of cruciform cross-section, passes, is located in a sunken web or connecting piece 21 so that concentrate residue cannot for practical purposes come as far as the opening of the bottle even after the latter has been removed.

The operation of the mixing container shown in FIGS. 1 to 5 is as follows:

Firstly the cap 4 of the mixing container is unscrewed and after removal of the screw on cap 18 the bottle 9 is plugged into the sleeve extension 6 with the bottle opening directed downwards and the lid 4 is then screwed onto the neck 3 again. Owing to this screwing on action the bottle 9 with the concentrated pesticide or the like is pushed downwards so that the pin 12 opens the ball valve. The medium located in the bottle 9 now passes into the container 1, which previously has been charged with water via the separate water inlet neck. The screw on lid 4 is turned until a graduation of the scale 17 is reached by the liquid medium in the mixing container. As soon as the desired quantity has been reached, the lid is screwed back in position and the valve spring 15 closes the bottle with the concentrate via the ball valve.

Figure 7:
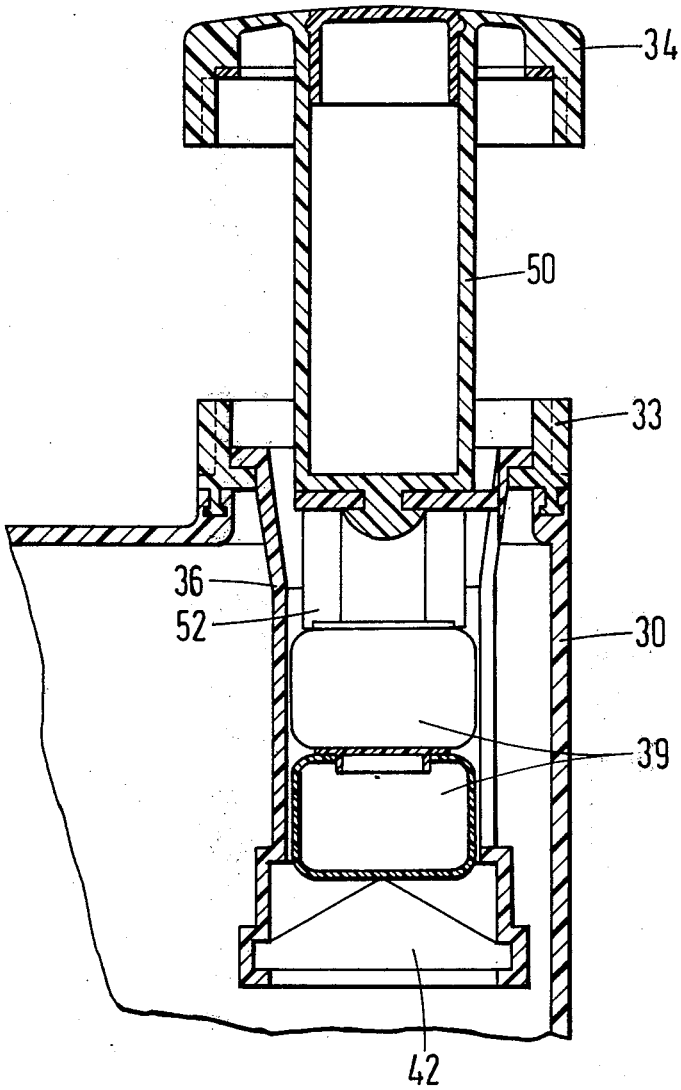
FIG. 7 shows on a larger scale a sectioned view of a chemical filling device with unopened concentrate capsules placed in it.
Figure 8:
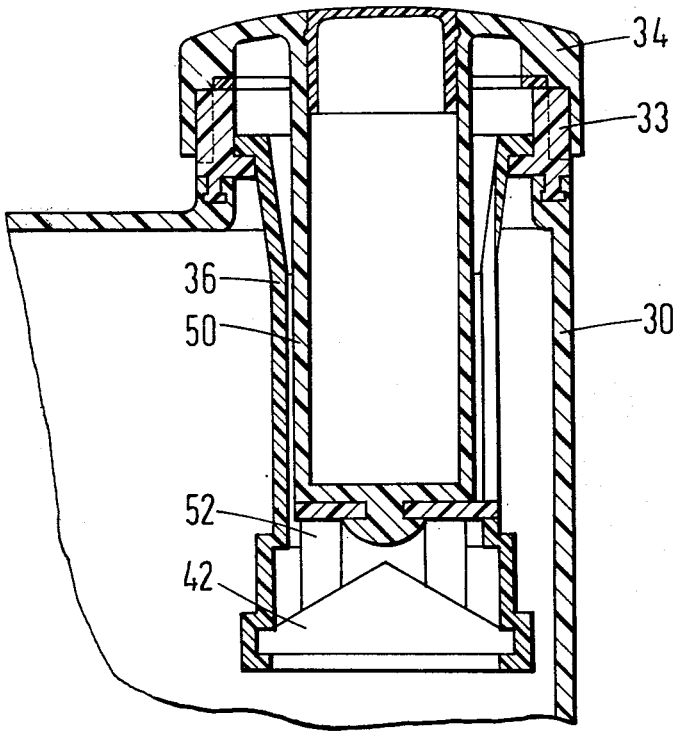
FIG. 8 shows a sectioned view, corresponding to FIG. 7, with the filling neck closed or sealed.

In the case of the embodiment in accordance with FIGS. 6 to 8 the container 30 provided with a carrying handle 35 has an inlet neck 33 for the concentrate, which can be closed by a lid in the form of a screw on cap 34. In accordance with FIGS. 7 and 8 the neck 33 adjoins on the inside a sleeve extension 36 which in the upper part is funnel-shaped, and whose inner opening carries a pointed cutting knife 42 running along the diameter. This cutting knife 42 forms the opener for the concentrate packages. In the embodiment of the invention shown these packages are constructed as capsules 39 of which, as can be seen from FIG. 7, two or more can be placed in the sleeve extension 36. The two capsules can comprise the same or several different components, which are mixed within the container on dissolving.

In order to avoid contact of the concentrate reliably a pressing punch 50 is moulded on the screw on lid 34 and the head part 52 of this punch 50 comes to lie against the capsules 39 so that the latter are cut open by the knife 42 when axial pressure is exerted on the lid 34.

The head 52 of the punch is connected in a rotary manner with the part 50 moulded on the screw on lid 34. The head 52 is provided with extensions, not indicated in the drawing, with which it is axially guided in lateral slots made in the sleeve extension 36. These slots and the extensions lie in a plane perpendicular to the plane of the drawing as in FIGS. 7 and 8. In this plane of FIGS. 7 and 8 the punch head 52 is slotted so that the knife 42 in the closed condition as shown in FIG. 8 can penetrate this head. In this manner it is possible to ensure that even small capsules can be opened and completely emptied or discharged.

The filling neck 33 is used both for filling with water and also with the pesticide. Firstly the lid 34 is unscrewed and the water can then be filled in the container. After the filling of the water the capsules 39 are placed into the sleeve extension 36. On introducing the pressing punch 50, 52 the capsules are pushed downwards and engage the knife 42. During this downward movement the knife cuts the capsules into two halves. The capsules with their contents drop into the container 30, which is filled with water. The punch head 52 is guided axially to prevent rotation during downward movement and is pushed over the knife 42.

What we claim is:

1. A mixing container for dispensing at least one material contained in at least one capsule into a vessel containing a second material, comprising:

a vessel for containing the second material; said vessel having an open, but closable, filling neck; a sleeve shaped extension projecting into said vessel from said filling neck to an inner end; said extension having an internal cross section defined by internal walls thereof;

a cutting knife near said extension inner end and located in said extension, and having a cutting edge facing toward said neck; said knife cutting edge extending completely across said extension between its said internal walls, whereby said knife cutting edge is so shaped and of such length and size as to cut completely through a capsule pressed against said knife edge;

at least one capsule positionable in said extension by insertion through said neck and having a width substantially of said extension cross section; said capsule being formed of a material capable of being cut through by a knife edge and said capsule being so shaped that upon said capsule being pressed against said knife edge, said knife slices completely through said capsule in a manner that said capsule can pass said knife and move into said vessel;

a capsule pressing punch insertable into said neck and adapted to pass through said extension; said capsule being located between said punch and said knife; said punch having a portion having a cross section that is substantially said cross section of said extension and that is shaped to meet with said knife cutting edge along substantially the entire length of said knife cutting edge; said punch being adapted to press against said capsule and press said capsule past said knife.

2. A mixing container in accordance with claim 1, characterised in that said extension is fixed in a non-detachable manner on said neck in said container.

3. A mixing container in accordance with claim 1, characterised in that said internal cross section of said extension substantially corresponds in shape to the shape of said capsule to guide said capsule toward said knife.

4. A mixing container in accordance with claim 3, characterised in that said extension is tapered in a funnel-like manner.

5. A mixing container in accordance with claim 1, characterised in that said knife is arranged so as to run along the entire length of a diameter of said extension and said punch portion is slotted in the plane of, over the entire length of and facing said knife cutting edge so that said knife can penetrate into said punch and completely cut through said capsule.

6. A mixing container according to claim 1, wherein said neck carries screw-on means; a lid to which said punch is secured; said lid carrying screw-on means that are shaped to cooperate with said neck screw-on means, whereby said punch is pressed against said capsule by being screwed on.

7. A mixing container in accordance with claim 6, characterised in that said pressing punch is connected in a rotary manner with said punch fixed to said lid.

8. A mixing container in accordance with claim 7, characterised in that said punch is guided axially within said extension by means of a slot and pin connection.

9. A mixing container according to claim 1, wherein said capsule is filled with a chemical with corrosive, poisonous, or the like potentially damaging characteristics.

* * * * *